US006448932B1

(12) United States Patent
Stoiljkovic et al.

(10) Patent No.: US 6,448,932 B1
(45) Date of Patent: Sep. 10, 2002

(54) DUAL FEED INTERNAL ANTENNA

(75) Inventors: Vladimir Stoiljkovic, Aylesbury; Shanmuganthan Suganthan, North Harrow; Peter Webster, Bletchley, all of (GB)

(73) Assignee: Centurion Wireless Technologies, Inc., Lincoln, NE (US)

( * ) Notice: Subject to any disclaimer, the term of this patent is extended or adjusted under 35 U.S.C. 154(b) by 0 days.

(21) Appl. No.: 09/945,918

(22) Filed: Sep. 4, 2001

(51) Int. Cl.[7] ..... H01Q 1/38
(52) U.S. Cl. ..... 343/700 MS; 343/702; 343/846
(58) Field of Search ..... 343/700 MS, 702, 343/725, 829, 846, 848; H01Q 1/38

(56) References Cited

U.S. PATENT DOCUMENTS 6,147,650 A * 11/2000 Kawahata et al. ... 343/700 MS
6,255,994 B1 * 7/2001 Saito ..... 343/700 MS
6,314,275 B1 * 11/2001 Pedersen et al. ..... 455/90
6,339,402 B1 * 1/2002 Mckivergan ..... 343/702
6,342,860 B1 * 1/2002 Haussler et al. ..... 343/702
6,343,208 B1 * 1/2002 Ying ..... 455/90

* cited by examiner

*Primary Examiner*—Tho G Phan
(74) *Attorney, Agent, or Firm*—Thomte, Mazour & Niebergall; Dennis L. Thomte

(57) ABSTRACT

A dual feed internal antenna is disclosed which provides an internal antenna with multiple frequency response through the use of two or more internal antennas within one package. Each internal antenna has its own feed and ground connection. For example, a planar inverted F antenna provides response at cellular telephone frequencies and an inverted F antenna provides response at Industrial, Scientific, and Medical (ISM) band of frequencies.

15 Claims, 2 Drawing Sheets

DUAL FEED INTERNAL ANTENNA

BACKGROUND OF THE INVENTION

1. Field of the Invention

The present invention relates to a planar inverted F antenna (PIFA) for wireless communication devices such as wireless modems, cellular telephones, personal digital assistants, etc. More particularly, the present invention relates to a method of providing multiple band response in a single antenna package.

2. Description of the Related Art

Recently, there has been an increasing thrust in the application of internal antennas in wireless communications. The concept of an internal antenna stems from the avoidance of using an external radiating element through the integration of the antenna into the communication device itself. Internal antennas have several advantageous features such as being less prone to external damage, a reduction in overall size of the communication device with optimization, and easy portability. In most internal antennas, the printed circuit board of the communication device serves as the ground plane of the internal antenna. Among the various choices for internal antennas, a PIFA appears to have great promise. The PIFA is characterized by many distinguishing properties such as relative lightweight, ease of adaptation and integration into the device chassis, moderate range of bandwidth, omni-directional radiation patterns in orthogonal principal planes for vertical polarization, versatility of optimization, and multiple potential approaches for size reduction. Its sensitivity to both vertical and horizontal polarization is of immense practical importance in mobile cellular/RF data communication applications because of the absence of the fixed antenna orientation as well as the multi-path propagation conditions. All these features render the PIFA to be a good choice as an internal antenna for mobile cellular/RF data communication applications.

SUMMARY OF THE INVENTION

In this invention, a new method of combining several planar inverted F and/or inverted F antennas in a single antenna unit is proposed. Several radiating patches are mounted on a common antenna carrier. The patches are made of materials suitable for use as connectors. The means of connecting the antenna to a PCB are described so that the integrated antenna can be mounted on a PCB using standard surface-mount techniques.

The principal objective of this invention is to provide a simple, low-cost means of providing a combination of planar inverted F antennas (PIFAs) and/or inverted F antennas (IFAs) in a single antenna package.

A further objective of the invention is to enable greater flexibility in the design of the radiating elements of an antenna to provide multi-band response, particularly in providing, for example, ISM frequency band response combined with standard cellular telephone frequency response.

Yet another objective is to provide means of attaching several radiating patches to a single antenna carrier.

These and other objects will be apparent to those skilled in the art.

DESCRIPTION OF THE PREFERRED EMBODIMENTS

Figure 1:
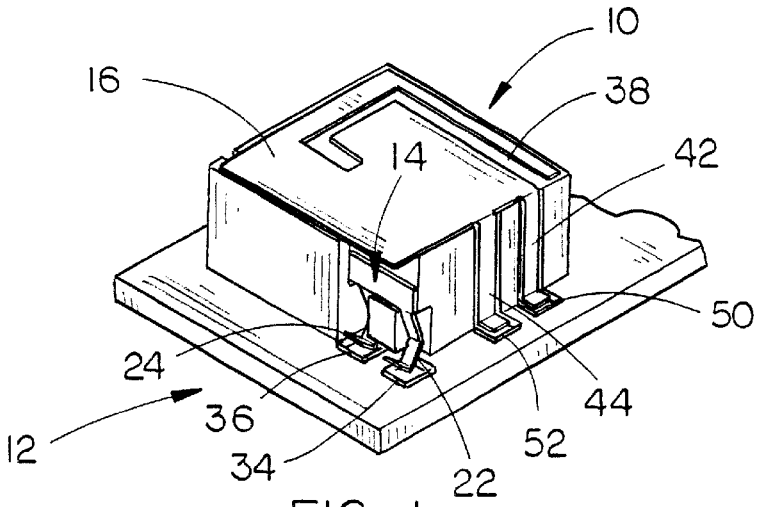
FIG. 1 is a perspective view of the preferred embodiment of the invention.
Figure 2:
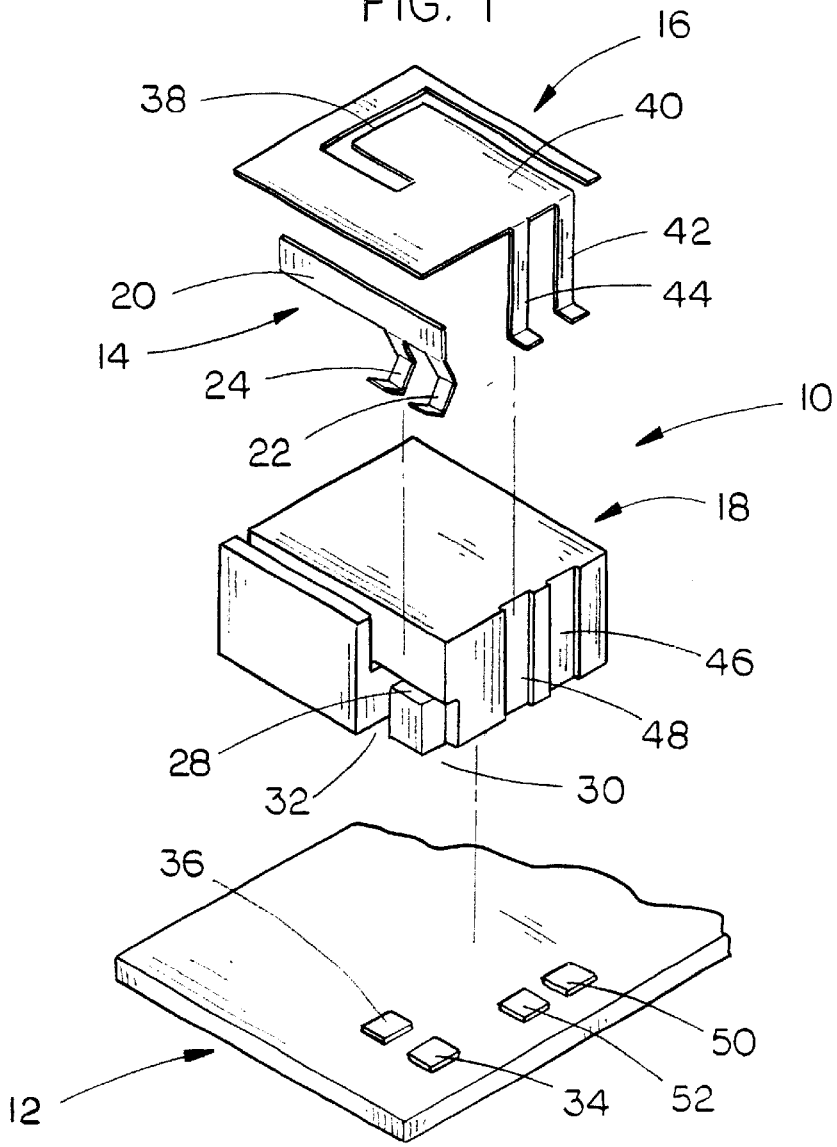
FIG. 2 is an exploded perspective view of the preferred embodiment of the invention illustrating the component parts thereof.

FIG. 1 illustrates the antenna assembly 10 of this invention attached to a printed circuit board (PCB) 12 such as may be found in a mobile communication device such as a cellular telephone. FIG. 2 is an exploded view of the antenna assembly 10 and PCB 12. The antenna assembly 10 comprises an inverted F antenna (IFA) 14 and a planar inverted F antenna (PIFA) 16 mounted on a carrier 18. Although the antenna assembly 10 is shown as using stamped metal radiating elements with combined connectors, it is also possible to produce the radiating elements from flexible PCBs, foils, plated plastic, or other suitable methods.

The inverted F antenna 14 provides response at ISM frequencies and comprises a flat surface 20 with feed and ground connections 22 and 24 extending therefrom, respectively. Antenna 14 is received and retained in a slot 26 formed in carrier 18 and is positioned on a ledge or shoulder 28 formed in carrier 18. Cut-outs 30 and 32 are provided in carrier 18 for receiving the feed and ground connectors 22 and 24, respectively, to allow the feed and ground connectors 22 and 24 to make contact with feed and ground pads 34 and 36 on the PCB 12. The inverted F antenna 14 may also be attached to the carrier 18 by means such as clipping, gluing, heat staking, etc.

The PIFA 16 provides response at cellular frequencies and may have a cut-out 38, as shown, to provide multiple frequency response. The PIFA 16 is attached to the carrier 18 by means such as clipping, gluing, heat staking, etc. (not shown). Antenna 16 includes a flat surface 40 having feed and ground connections 42 and 44 extending perpendicularly therefrom, as seen in FIG. 2. Cutouts 46 and 48 are provided in carrier 18 to allow the feed and ground connectors 42 and 44 to extend therethrough to make contact with feed and ground pads 50 and 52, respectively, on the PCB 12.

The antenna assembly 10 is attached to the PCB 12 using suitable fixing methods to ensure that appropriate contact pressure is maintained between the feed and ground connectors 22, 24, 42, and 44 and the PCB pads 34, 36, 50, and 52, respectively.

Figure 3:
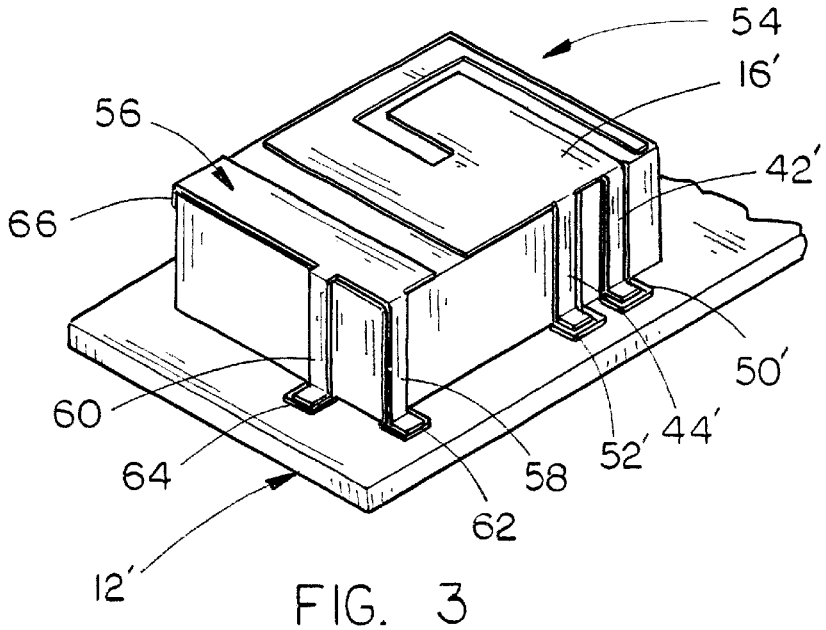
FIG. 3 is a perspective view of another embodiment of the invention.
Figure 4:
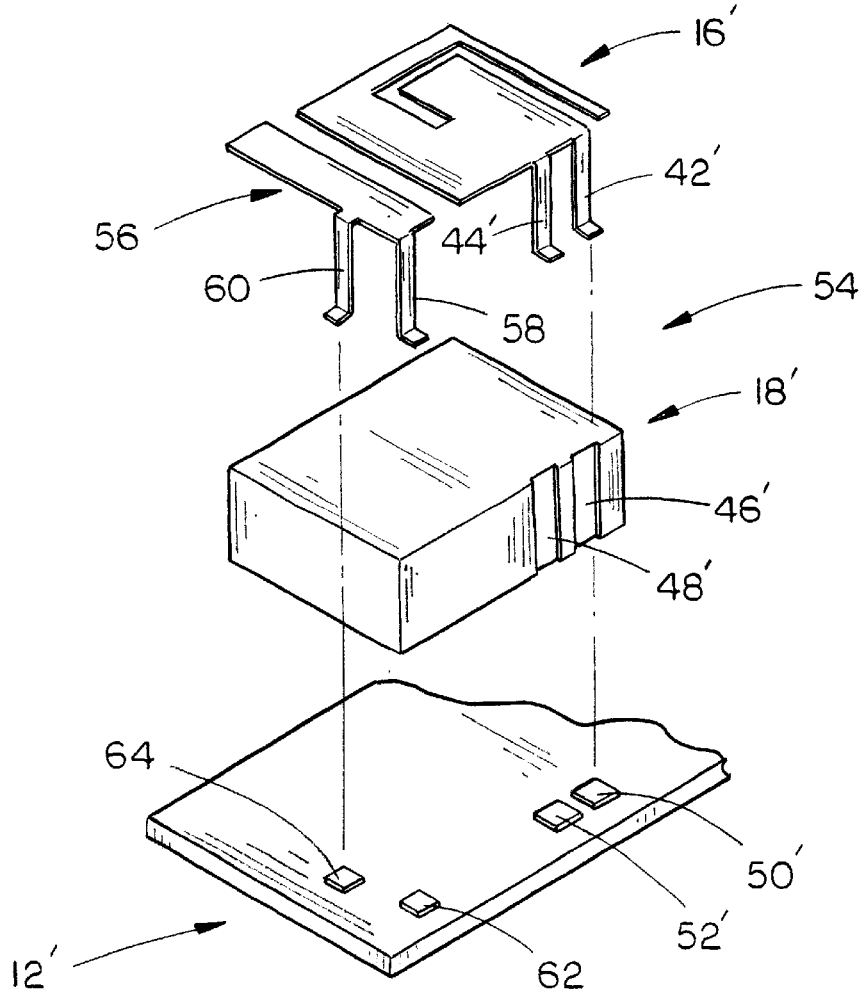
FIG. 4 is an exploded perspective view of the embodiment of FIG. 3.

A further antenna embodiment is shown in FIGS. 3 and 4 and is designated with the reference numeral 54. That structure on antenna 54 which is identical to antenna 10 will be designated with "'". An alternative to the inverted F antenna 14 of FIGS. 1 and 2 is provided by a second PIFA 56. PIFA 56 is coplanar with PIFA 16' and is provided with feed and ground connectors 58 and 60 extending therefrom, which make contact with feed and ground pads 62 and 64 on PCB 12', respectively. A fold-over section 66 may or may not be provided on PIFA 56, as seen in FIG. 3. The second PIFA 56 may be attached to the carrier 18' in various manners as previously discussed. Carrier 18' is essentially identical to carrier 18 except that it does not have the elements 26, 28, 30, and 32.

As can be seen from the foregoing, at least two novel schemes for the design of an integrated radio/antenna device have been developed and demonstrated. Thus it can be seen that the present invention presents the novel techniques of providing a multi-band frequency response in a single antenna package.

It can therefore be seen that the invention accomplishes at least all of its stated objectives.

We claim:

1. In combination:

a wireless communication device including a printed circuit board (PCB);

said PCB having spaced-apart first, second, third, and fourth feed/ground pads provided thereon;

a dual feed internal antenna operatively mounted on said PCB;

said dual feed internal antenna comprising a carrier, an inverted F antenna mounted on said carrier, and a planar inverted F antenna mounted on said carrier;

said inverted F antenna having first and second feed/ground connectors extending therefrom which are in contact with said first and second feed/ground pads on said PCB;

said planar inverted F antenna having third and fourth feed/ground connectors extending therefrom which are in contact with said third and fourth feed/ground pads on said PCB.

2. The combination of claim 1 wherein said inverted F antenna comprises a flat member having said first and second feed/ground connectors extending therefrom.

3. The combination of claim 2 wherein said flat member and said first and second feed/ground connectors are of integral construction.

4. The combination of claim 1 wherein said inverted F antenna provides response at ISM frequencies.

5. The combination of claim 4 wherein said planar inverted F antenna provides response at cellular frequencies.

6. The combination of claim 1 wherein said planar inverted F antenna provides response at cellular frequencies.

7. The combination of claim 1 wherein said planar inverted F antenna comprises a flat member having said third and fourth feed/ground connectors extending perpendicularly therefrom.

8. The combination of claim 1 wherein said carrier has first, second, third, and fourth cut-out areas formed therein which receive said first, second, third, and fourth feed/ground connectors therein, respectively.

9. In combination:

a wireless communication device including a printed circuit board (PCB);

said PCB having spaced-apart first, second, third, and fourth feed/ground pads provided thereon;

a dual feed internal antenna operatively mounted on said PCB;

said dual feed internal antenna comprising a carrier, a first planar inverted F antenna (PIFA) mounted on said carrier, and a second planar inverted F antenna (PIFA) mounted on said carrier;

said first and second PIFAs being coplanar with respect to one another;

said first PIFA having first and second feed/ground connectors extending therefrom which are in contact with said first and second feed/ground pads on said PCB, respectively;

said second PIFA having third and fourth feed/ground connectors extending therefrom which are in contact with said third and fourth feed/ground pads on said PCB, respectively.

10. The combination of claim 9 wherein said first PIFA comprises a flat member having said first and second feed/ground connectors extending therefrom.

11. The combination of claim 10 wherein said flat member of said first PIFA and said first and second feed/ground connectors are of integral construction.

12. The combination of claim 10 wherein said first PIFA includes a second flat member which extends from the flat member thereof and which is disposed perpendicularly with respect thereto.

13. The combination of claim 9 wherein said second PIFA comprises a flat member having said third and fourth feed/ground connectors extending therefrom.

14. The combination of claim 13 wherein said flat member of said second PIFA and said third and fourth feed/ground connectors are of integral construction.

15. The combination of claim 9 wherein said carrier has first, second, third, and fourth cut-out areas formed therein which receive said first, second, third, and fourth feed/ground connectors therein, respectively.

* * * * *